US006739315B2

(12) United States Patent
Kurita et al.

(10) Patent No.: US 6,739,315 B2
(45) Date of Patent: May 25, 2004

(54) THROTTLE VALVE CONTROL DEVICE FOR AN INTERNAL COMBUSTION ENGINE

(75) Inventors: Kazuhisa Kurita, Tokyo (JP); Kenji Nakao, Tokyo (JP); Teruhiko Moriguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 89 days.

(21) Appl. No.: 10/002,209

(22) Filed: Dec. 5, 2001

(65) Prior Publication Data

US 2002/0179049 A1 Dec. 5, 2002

(30) Foreign Application Priority Data

May 30, 2001 (JP) ..... 2001-162100

(51) Int. Cl.[7] ..... F02D 11/10; F02D 9/02; F02D 9/10

(52) U.S. Cl. ..... 123/399; 251/305; 251/129.11

(58) Field of Search ..... 123/399, 337, 123/339.1, 339.12, 339.14, 339.19; 251/305, 129.11, 129.12, 129.13

(56) References Cited

U.S. PATENT DOCUMENTS 6,092,506 A * 7/2000 Takagi et al. ..... 123/399
6,173,939 B1 * 1/2001 Dottavio et al. ..... 251/129.12

FOREIGN PATENT DOCUMENTS

JP 2000-282898 10/2000

OTHER PUBLICATIONS

"Gears from Scratch" by Paul Sharke; Dec. 2001, Mechanical Engineering.*

Palomar Integral Field Spectrograph (PIFS) webpage dated Aug. 18, 1998 by Tom Murphy et al. at California Institute of Technology.*

* cited by examiner

*Primary Examiner*—Mahmoud Gimie
*Assistant Examiner*—Arnold Castro
(74) *Attorney, Agent, or Firm*—Sughrue Mion, PLLC

(57) ABSTRACT

A throttle valve control device for an internal combustion engine is obtained which has an improved sector gear 20 capable of suppressing inclinations of tooth surfaces 22*a* of its resin teeth 22 due to shrinkage of a resin upon hardening thereof at the time of insert molding. The throttle valve control device includes a motor 2 and the sector gear 20 operatively connected with the motor 2 for driving a shaft 8, on which a throttle valve 20 is fixedly mounted, by means of power transmitted thereto from said motor. The sector gear 20 has a sector-shaped rigid core member 21, and a resin molded portion 23 with the teeth 22 formed on the core member 21 by insert molding. The core member 21 has a support portion 24 with a curved surface 24*a* formed to extend along bottoms 22*b* of the teeth 22 and project in an axial direction as well.

15 Claims, 8 Drawing Sheets

THROTTLE VALVE CONTROL DEVICE FOR AN INTERNAL COMBUSTION ENGINE

This application is based on Application No. 2001-162100, filed in Japan on May 30, 2001, the contents of which are hereby incorporated by reference.

BACKGROUND OF THE INVENTION

1. Field of the Invention

The present invention relates to a throttle valve control device for an internal combustion engine in which the rotation of a motor corresponding to an amount of operation of an accelerator pedal is transmitted through a gear mechanism to a shaft of a throttle valve, which adjusts the amount of intake air sucked into the internal combustion engine.

2. Description of the Related Art

FIG. 7 is a cross sectional side view of a known throttle valve control device for an internal combustion engine. This throttle valve control device for an internal combustion engine includes a housing 1, a motor 2 provided in the housing 1, a small gear wheel 4 fixed to a rotating shaft 3 of the motor 2, an intermediate gear wheel 5 in mesh with the small gear wheel 4, a sector gear 6 in mesh with the intermediate gear wheel 5, a shaft 7 rotatably mounted on the housing 1 across an intake passage formed therein with the sector gear 6 fixedly attached thereto at its one end, a throttle valve 8 fixedly mounted on the shaft 7 for rotation therewith, a return spring 9 for urging the throttle valve 8 in its closing direction at all times through the shaft 7, and an opening sensor 10 fixedly attached to the shaft 7 on one side of the sector gear 6 opposite the throttle valve 8 for detecting the opening of the throttle valve 8.

FIG. 8 is a front elevation of the sector gear 6, and FIG. 9 is a cross sectional view along line IX—IX of the sector gear 6 of FIG. 8. The sector gear 6 is comprised of a generally sector-shaped core member 11 and a resin molded portion 13 with teeth 12 formed on the core member 11 by means of insert molding. The core member 11 is formed by pressing a metal sheet. The metal sheet is used for ensuring the proper strength of the sector gear 6.

FIG. 10 is a front elevation of a sector gear 15 of another example, and FIG. 11 is a cross sectional view along line XI—XI of the sector gear 15 of FIG. 10. This sector gear 15 is formed on the whole by sinter molding a ferrous material.

With the known sector gear 6 as described above, the resin molded portion 13 having the teeth 12 is formed on the core member 11 by means of insert molding, but in this case, there arises a problem that a molding sink 16 as shown by a dotted line in FIG. 12 is caused on the tooth surfaces 12*a* of the teeth 12 under the action of shrinkage occurring upon hardening of the resin, whereby the tooth surfaces or crest surfaces 12*a* are caused to incline in a diametral or radial direction from a horizontal line, as illustrated in FIGS. 13A and 13B.

In addition, with the sector gear 15 which on the whole is molded by sintering, inclinations of the tooth surfaces of the teeth 12 can be avoided, and hence the sector gear 15 is improved in accuracy and reliability, but gives rise to another problem that the weight of the sector gear 15 is substantially increased.

SUMMARY OF THE INVENTION

The present invention is intended to obviate the problems as referred to above, and has for its object to provide a throttle valve control device for an internal combustion engine which has a sector gear with improved teeth accuracy by preventing inclinations of the teeth surfaces.

Bearing the above object in mind, the present invention resides in a throttle valve control device for an internal combustion engine comprising a motor and a sector gear operatively connected with the motor for driving a shaft having a throttle valve fixedly mounted thereon, the sector gear including a sector-shaped core member and a resin molded portion with teeth formed on the core member by insert molding. The throttle valve control device is characterized in that the core member has a support portion with a curved surface formed to extend along bottoms of the teeth and project in an axial direction.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described in detail while referring to the accompanying drawings. The following description will be made by identifying the same or corresponding parts or locations with the same symbols as employed in FIGS. 7 through 12 and FIGS. 13A and 13B.

Embodiment 1.

Figure 1:
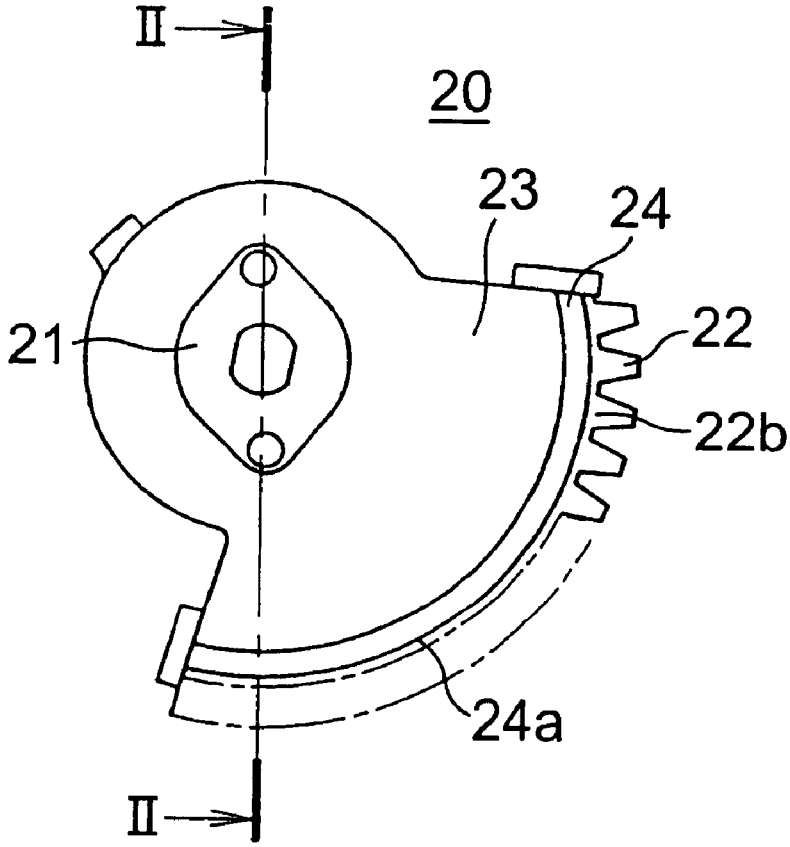
FIG. 1 is a front elevation of a sector gear used with a throttle valve control device for an internal combustion engine according to a first embodiment of the present invention.
Figure 2:
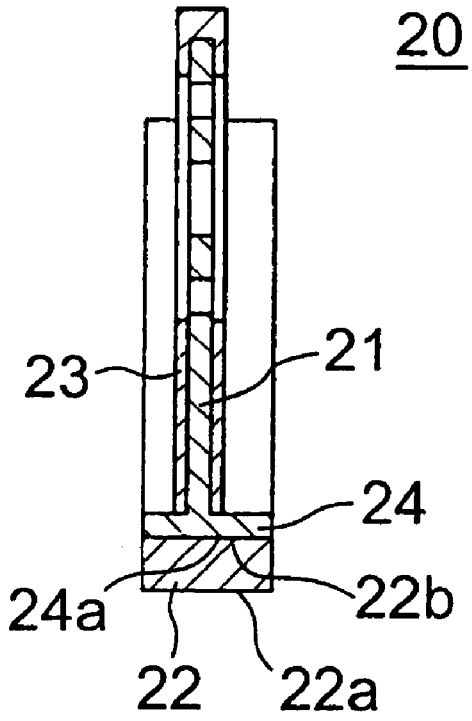
FIG. 2 is a cross sectional view of the sector gear along line II—II of FIG. 1.

FIG. 1 is a front elevation of a sector gear 20 used with a throttle valve control device for an internal combustion engine in accordance with a first embodiment of the present invention. FIG. 2 is a cross sectional view of the sector gear 20 along line II—II of FIG. 1. The sector gear 20 is comprised of a sector-shaped core member 21 and a resin molded portion 23 with teeth 22 formed on or fitted over the core member 21 by insert molding. The core member 21 is formed by cutting a metal member into a T-shaped cross sectional configuration along an axial direction. The core member 21 has a support portion 24 which is formed to extend along bottoms 22*b* of the teeth 22 in a circumferential direction and project in an axial direction as well. The support portion 24 is formed along the bottoms 22*b* of the teeth 22 and has a curved surface 24*a*.

In the sector gear 20 of this embodiment, the resin molded portion 23 having the teeth 22 is formed on or fitted over the core member 21 by insert molding, but in this case, the support portion 24 of the core member 21 serves to suppress a molding sink or shrinkage of the resin due to a shrinking action occurring upon hardening of the resin. As a result, inclinations of the tooth surfaces 22*a* of the teeth 22 can be suppressed. In addition, by enhancing the cutting accuracy of the support portion 24, it is possible to more effectively prevent the tooth surfaces 22*a* of the teeth 22 from being inclined.

Embodiment 2.

Figure 3:
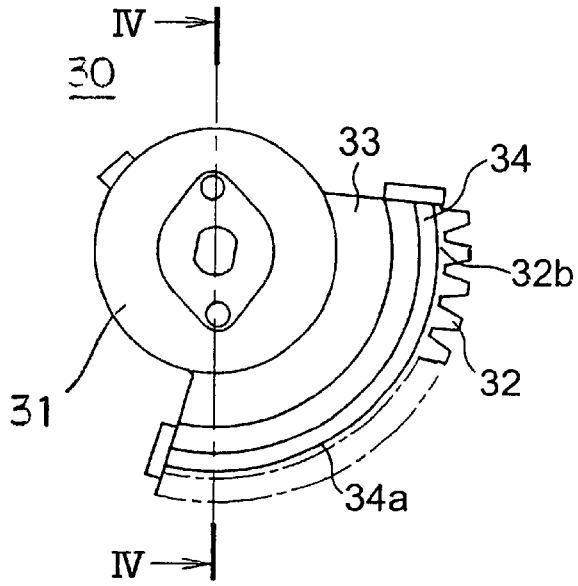
FIG. 3 is a front elevation of the sector gear used with a throttle valve control device for an internal combustion engine according to a second embodiment of the present invention.
Figure 4:
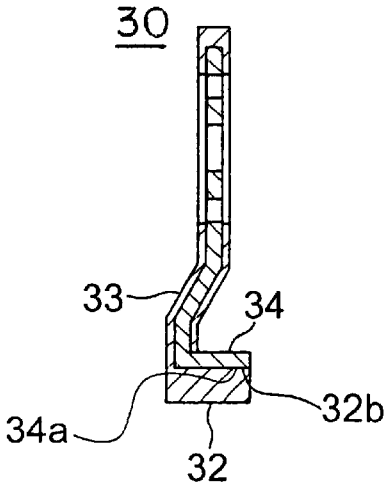
FIG. 4 is a cross sectional view of the sector gear along line IV—IV of FIG. 3.

FIG. 3 is a front elevation of a sector gear 30 used with a throttle valve control device for an internal combustion engine in accordance with a second embodiment of the present invention. FIG. 4 is a cross sectional view of the sector gear 30 along line IV—IV of FIG. 3. The sector gear 30 is comprised of a sector-shaped core member 31 and a resin molded portion 33 with teeth 32 formed on or fitted over the core member 31 by insert molding. The core member 31 is formed of a sheet metal which has a support portion 34 folded in an axial direction. The support portion 34 is formed along the bottoms 32*b* of the teeth 32, and has a curved surface 34*a*.

In this embodiment, the support portion 34 can be formed by the folding processing of the sheet metal, and hence the folding processing is simple and easy as compared with the cutting processing in the first embodiment, thus making it possible to manufacture the sector gear 30 at low costs.

Embodiment 3.

Figure 5:
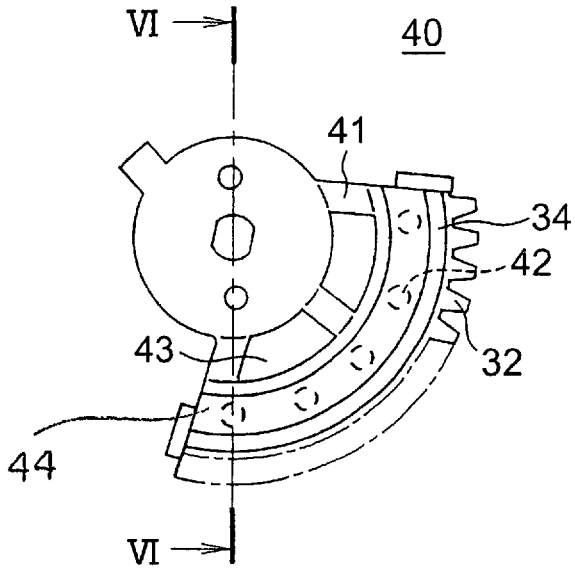
FIG. 5 is a front elevation of a sector gear used with a throttle valve control device for an internal combustion engine according to a third embodiment of the present invention.
Figure 6:
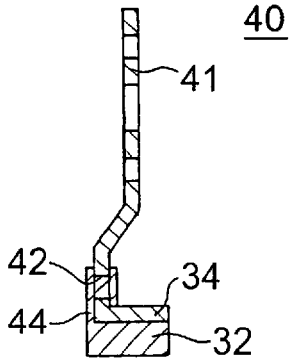
FIG. 6 is a cross sectional view of the sector gear along line VI—VI of FIG. 5.
Figure 7:
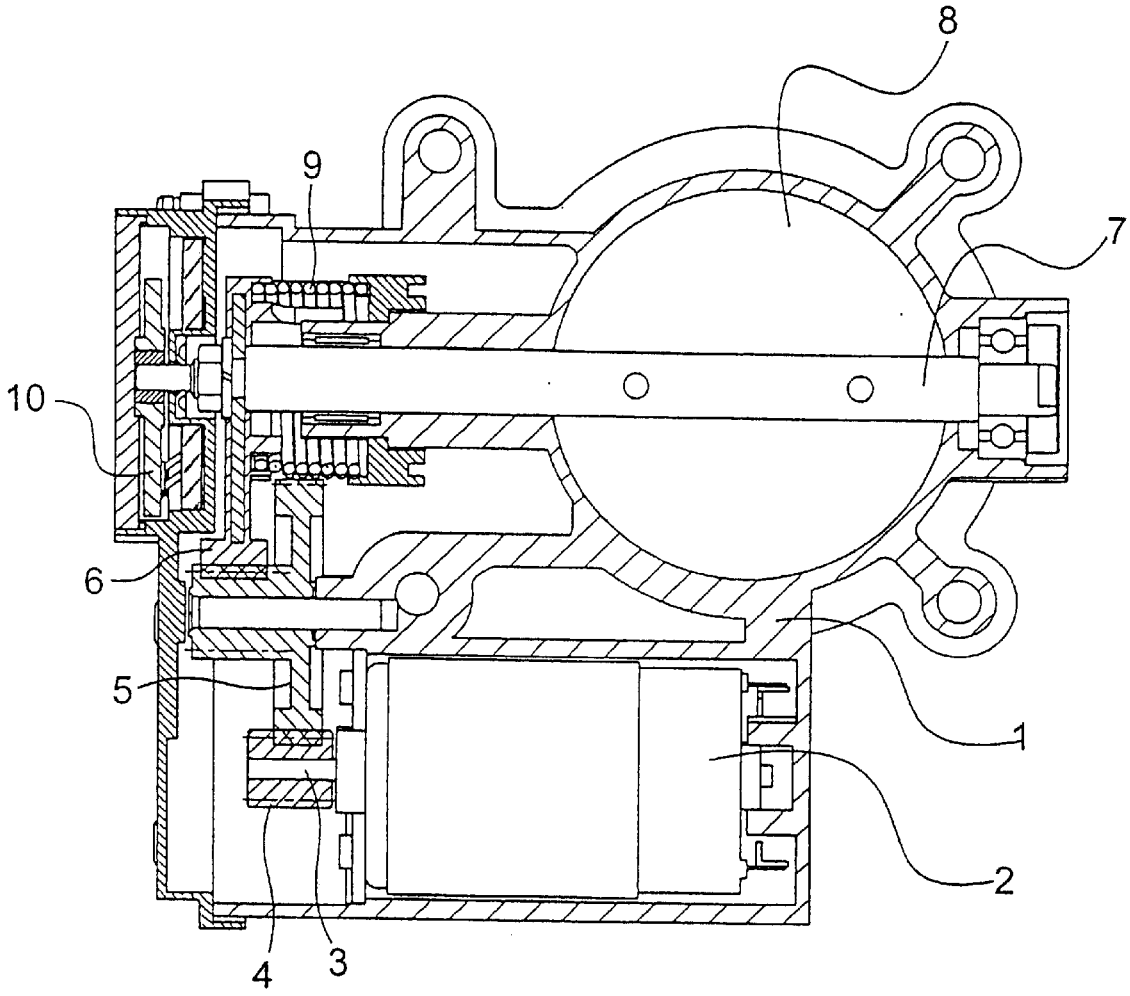
FIG. 7 PRIOR ART
FIG. 7 is a side cross sectional view of a known throttle valve control device for an internal combustion engine.
Figure 8:
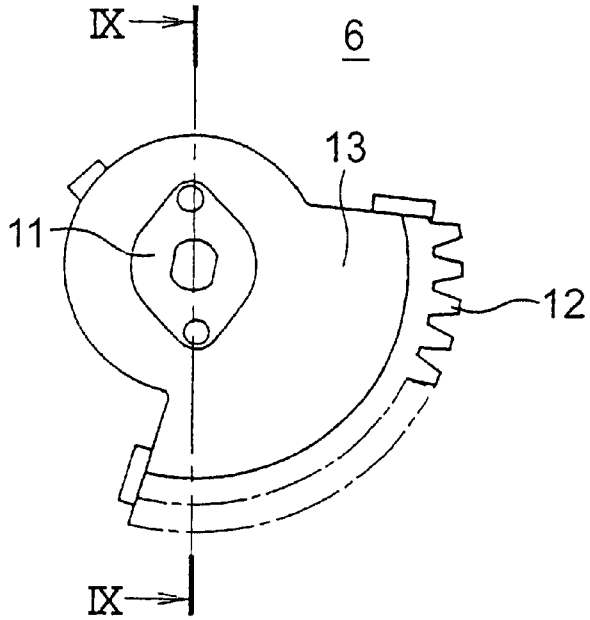
FIG. 8 PRIOR ART
FIG. 8 is a front elevation of the sector gear of FIG. 7.
Figure 9:
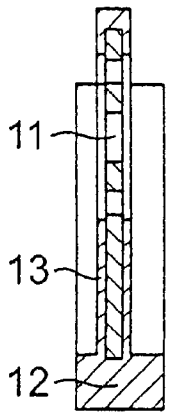
FIG. 9 PRIOR ART
FIG. 9 is a cross sectional view of the sector gear along line IX—IX of FIG. 8.
Figure 10:
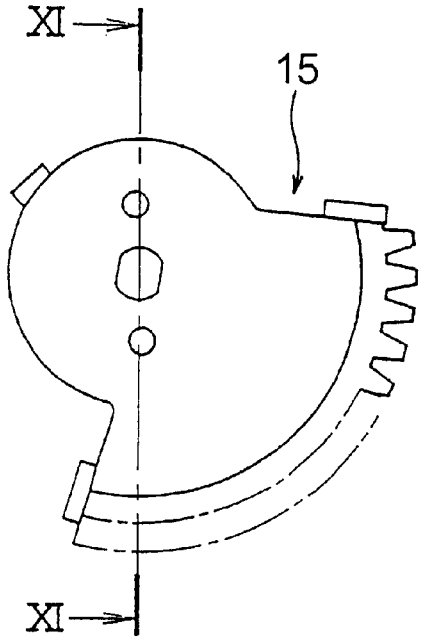
FIG. 10 PRIOR ART
FIG. 10 is a front elevation of a known sector gear of another example.
Figure 11:
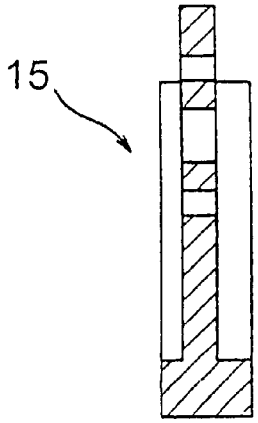
FIG. 11 PRIOR ART
FIG. 11 is a cross sectional view of the sector gear along line XI—XI of FIG. 10.
Figure 12:
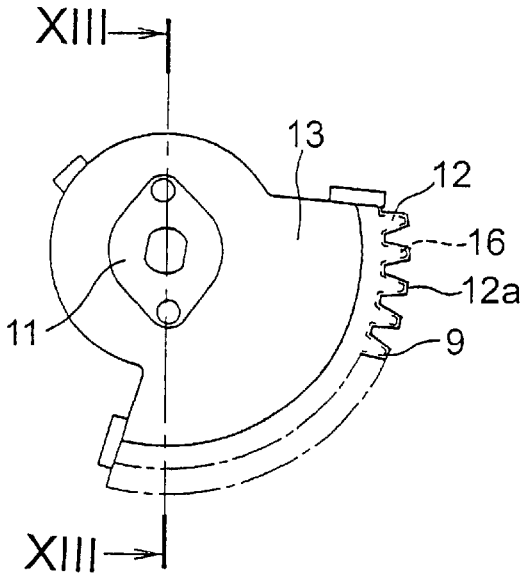
FIG. 12 PRIOR ART
FIG. 12 is a front elevation of the sector gear when the sector gear of FIG. 8 is deformed by a molding sink of a resin.
Figure 13A:
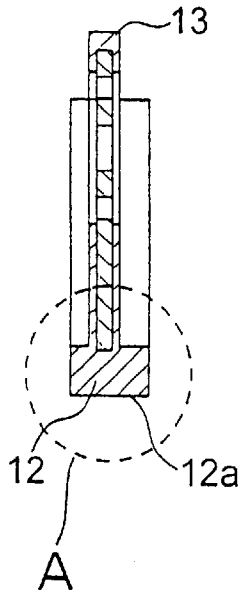
FIG. 13A PRIOR ART
FIG. 13A is a cross sectional view along line XIII—XIII of FIG. 12.
Figure 13B:
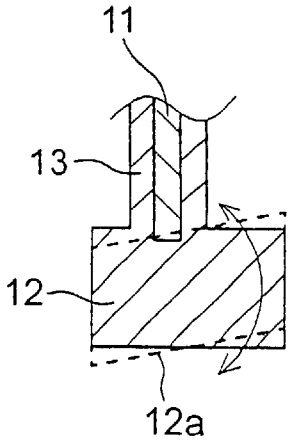
FIG. 13B PRIOR ART
FIG. 13B is an enlarged view of a circled part A of FIG. 13A.

FIG. 5 is a front elevation of a sector gear 40 used with a throttle valve control device for an internal combustion engine in accordance with a third embodiment of the present invention. FIG. 6 is a cross sectional view of the sector gear 40 along line VI—VI of FIG. 5.

This embodiment is different from the second embodiment in that a core member 41 of the sector gear 40 is formed with a plurality of holes 42 for integrally combining the core member 41 and a resin molded portion 44 with each other, and a plurality of windows 43 are formed in the core member 41 at one side thereof opposite the teeth 32.

In this embodiment, the core member 41 and the resin molded portion 44 are integrally formed with each other through the resin filled in the holes 42, so it is unnecessary to cover the entire core member 41 with the resin, as in the second embodiment. Additionally, the most parts of the resin molded portion 44 are occupied by the teeth 32, and the windows 43 are formed in the core member 41. As a result, the weight of the sector gear 40 is reduced.

As described in the foregoing, the present invention provides the following advantages.

According to the present invention, a throttle valve control device for an internal combustion engine comprises a motor and a sector gear operatively connected with the motor for driving a shaft having a throttle valve fixedly mounted thereon, the sector gear including a sector-shaped core member and a resin molded portion with teeth formed on the core member by insert molding. The core member has a support portion with a curved surface formed to extend along bottoms of the teeth and project in an axial direction. With this arrangement, the support portion serves to prevent inclinations of tooth surfaces of the teeth due to a molding sink of the resin caused under the action of shrinkage upon hardening of the resin, thus improving the accuracy of the sector gear.

In addition, in comparison with the aforementioned known sector gear which on the whole is formed of a metal sintered material, the sector gear of the invention is light in weight and has the teeth formed of a resin, so that it is possible to suppress to an extremely limited level the collision sounds of the teeth generated when the teeth of the sector gear come into meshing engagement with the teeth of a mating gear wheel.

In another preferred form of the invention, the core member has a T-shaped cross section along an axial direction. Thus, it is possible to prevent the tooth surfaces of the teeth from being inclined due to a molding sink of the resin under the action of the support portion.

In a further preferred form of the invention, the core member comprises a metal member formed by cutting. Thus, the support portion can be easily formed.

In a yet further preferred form of the invention, the core member comprises a sheet metal which is folded to form a support portion. Thus, the support portion can be easily formed by means of folding processing.

In a still further preferred form of the invention, the core member is formed with holes for integrally combining the core member and the resin molded portion with each other, whereby the core member and the resin molded portion are strongly integrated with each other by means of a resin filled in the holes.

In a further preferred form of the invention, the core member has windows formed at its one side opposite the teeth, so the weight of the stator can be reduced.

While the invention has been described in terms of preferred embodiments, those skilled in the art will recognize that the invention can be practiced with modifications within the spirit and scope of the appended claims.

What is claimed is:

1. A throttle valve control device for an internal combustion engine, comprising a motor and a sector gear operatively connected with said motor for driving a shaft having a throttle valve fixedly mounted thereon by means of power transmitted thereto from said motor, wherein:

said sector gear comprises a sector-shaped core member and a resin molded portion with teeth formed on said core member by insert molding, and said core member has a support portion with a curved surface formed to extend along bottoms of said teeth and project in an axial direction.

2. The throttle valve control device for an internal combustion engine according to claim 1, wherein said core member has a T-shaped cross section along an axial direction.

3. The throttle valve control device for an internal combustion engine according to claim 2, wherein said core member comprises a metal member formed by cutting.

4. The throttle valve control device for an internal combustion engine according to claim 1, wherein said core member comprises a section of sheet metal which is folded to form a support portion.

5. The throttle valve control device for an internal combustion engine according to claim 1, wherein said core member has holes for integrally combining said core member and said resin molded portion with each other.

6. The throttle valve control device for an internal combustion engine according to claim 1, wherein said core member has windows formed at its one side opposite said teeth.

7. The throttle valve control device for an internal combustion engine according to claim 1, wherein said core member has a generally L-shaped cross section along an axial direction, and said vertex of said L-shape is laterally offset from a plane where the majority of said core member extends.

8. The throttle valve control device for an internal combustion engine according to claim 1, wherein said support portion projects in an axial direction both in front of and behind said core member.

9. The throttle valve control device for an internal combustion engine according to claim 1, wherein said teeth are substantially supported along their axial dimension by said support portion.

10. The throttle valve control device for an internal combustion engine according to claim 1, wherein said teeth are fully supported along their axial dimension by said support portion.

11. The throttle valve control device for an internal combustion engine according to claim 1, wherein said teeth project radially outward.

12. The throttle valve control device for an internal combustion engine according to claim 1, wherein said resin molded portion covers only a radially outer portion of said core member.

13. The throttle valve control device for an internal combustion engine according to claim 1, wherein said core member has a window formed on a radially inner portion.

14. The throttle valve control device for an internal combustion engine according to claim 13, wherein said resin molded portion covers a portion of said core member radially outside said window.

15. The throttle valve control device for an internal combustion engine according to claim 13, wherein said window is polygon shaped.

* * * * *